US010047566B2

(12) United States Patent
Vaughn et al.

(10) Patent No.: US 10,047,566 B2
(45) **Date of Patent: *Aug. 14, 2018**

(54) CUTTER TOOL INSERT HAVING SENSING DEVICE

(71) Applicant: Diamond Innovations, Inc., Worthington, OH (US)

(72) Inventors: Joel Vaughn, Groveport, OH (US); Steven W Webb, Woodlands, TX (US); Patrick Georges Gabriel Dapsalmon, Paris (FR)

(73) Assignee: DIAMOND INNOVATIONS, INC., Worthington, OH (US)

( * ) Notice: Subject to any disclaimer, the term of this patent is extended or adjusted under 35 U.S.C. 154(b) by 228 days.

This patent is subject to a terminal disclaimer.

(21) Appl. No.: 14/971,040

(22) Filed: Dec. 16, 2015

(65) Prior Publication Data

US 2016/0097241 A1 Apr. 7, 2016

Related U.S. Application Data

(63) Continuation of application No. 13/530,073, filed on Jun. 21, 2012, now Pat. No. 9,222,350.

(60) Provisional application No. 61/499,311, filed on Jun. 21, 2011.

(51) Int. Cl.

| | |
|---|---|
| ***E21B 10/46*** | (2006.01) |
| ***E21B 10/55*** | (2006.01) |
| ***E21B 10/567*** | (2006.01) |
| ***E21B 10/573*** | (2006.01) |
| ***E21B 10/56*** | (2006.01) |
| ***E21B 47/01*** | (2012.01) |
| ***E21B 12/02*** | (2006.01) |
| ***E21B 10/36*** | (2006.01) |
| ***E21B 47/00*** | (2012.01) |

(52) U.S. Cl.

CPC ..... *E21B 10/56* (2013.01); *E21B 10/36* (2013.01); *E21B 10/46* (2013.01); *E21B 12/02* (2013.01); *E21B 47/00* (2013.01); *E21B 47/01* (2013.01); *Y10T 156/10* (2015.01)

(58) Field of Classification Search

CPC .... E21B 10/46; E21B 10/55; E21B 2010/561; E21B 2010/565; E21B 10/567; E21B 10/573; E21B 10/5735; E21B 10/62; E21B 12/02

See application file for complete search history.

(56) References Cited

U.S. PATENT DOCUMENTS

2003/0062197 A1* 4/2003 Moran ..... E21B 10/24 175/39
2009/0090563 A1* 4/2009 Voronin ..... B22F 7/06 175/434

(Continued)

*Primary Examiner* — Cathleen R Hutchins
(74) *Attorney, Agent, or Firm* — Eric Shaffer

(57) ABSTRACT

A cutting element for an earth-boring drilling tool and its method of making are provided. The cutting element may include a substrate, a superhard layer, and a sensing element. The superhard layer may be bonded to the substrate along an interface. The superhard layer may have a working surface opposite the interface and an outer peripheral surface. The outer peripheral surface may extend between the working surface and the interface. The sensing element may comprise at least a part of the superhard layer.

17 Claims, 4 Drawing Sheets

(56) References Cited

U.S. PATENT DOCUMENTS

2010/0118657 A1* 5/2010 Trinh ..... E21B 47/011
367/82
2011/0266055 A1* 11/2011 DiGiovanni ..... E21B 10/08
175/50

* cited by examiner

CUTTER TOOL INSERT HAVING SENSING DEVICE

CROSS-REFERENCE TO RELATED APPLICATIONS

This application is based on and claims the priority benefit of previously filed U.S. Provisional Patent Application No. 61/499,311, which was filed Jun. 21, 2011.

TECHNICAL FIELD AND INDUSTRIAL APPLICABILITY

The present disclosure relates to a cutting tool insert for use in earth boring operations, and specifically to a cutting tool insert capable of providing feedback relating to conditions of the cutting tool insert itself by way of a sensing device within the cutting tool insert.

Earth boring operations are conducted using rotary earth boring bits mounted at the end of a long shaft that extends into the hole being bored Earth boring bits typically includes a plurality of cutting tool inserts having hard cutting surfaces that can grind into the earth. Several types of earth boring bits are known; coring bits, roller cone bits and shear cutter bits. The cutting tool inserts may comprise hard metal, ceramics, or superhard materials such as diamond or cubic boron nitride.

During earth boring operations, the working surface of the inserts may reach temperatures as high as 700° C., even when cooling measures are employed. It can be appreciated that due to the high contact pressure between the cutting insert and the earth formation, that large temperature gradients may exist between the actual contact point and surfaces remote from the contact point. The maximum temperature and the gradient may damage the cutting tool, reducing the economic life of the earth boring bit. To an operator located remote from the earth boring tool, the condition of the earth boring cutters may only be inferred from the overall bit performance.

There is essentially no direct feedback from the earth boring bit to indicate wear on the cutting tool inserts, or conditions that would signal imminent failure of one or more of the cutting tool inserts. Only after a failure has occurred does an operator get feedback of a problem, when the earth boring bit cutting rate decreases, the bit can no longer turn or power must be increased to cut into the earth. At that point, it is too late to avoid the costly and time consuming remedial work of withdrawing the entire shaft and earth boring bit form the hole and repairing the earth boring bit by removing and replacing failed cutting tool inserts. It would be preferable to provide a cutting tool insert, and method of boring using a cutting tool insert that provides the operator with sufficient information to be able to adjust drilling parameters such as torque, weight on the bit, and rotational speed in order to prevent cutting tool failures.

Therefore, it can be seen there is need for a cutting element integrated with sensing elements to be used in earth-boring drilling tool.

SUMMARY

In one embodiment, a cutting element for earth-boring drilling tool comprises a substrate, a superhard layer bonded to the substrate along an interface, the superhard particle layer having a working surface opposite the interface and an outer peripheral surface extending between the working surface and the interface; and a sensing element comprising at least a part of the superhard layer.

In another embodiment, a method of making a cutting element for earth-boring drilling tool, comprises steps of providing a superhard layer wherein at least a part of superhard layer comprises a sensing element and transferring means; providing a substrate; and bonding the substrate to the superhard layer.

In yet another embodiment, an apparatus comprises a superhard layer having a working surface and an interface opposite to the working surface, the superhard layer further comprising an outer peripheral surface extending between the working surface and the interface, wherein the superhard layer has a sensing element and a connector, wherein the sensing element is configured to generate information relating to the superhard layer and the connector is configured to send information generated from the sensing element to a circuit.

BRIEF DESCRIPTION OF THE DRAWINGS

The foregoing, as well as the following detailed description of the embodiments, will be better understood when read in conjunction with the appended drawings. For the purpose of illustration, there are shown in the drawings some embodiments which may be preferable. It should be understood, however, that the embodiments depicted are not limited to the precise arrangements and instrumentalities shown.

DETAILED DESCRIPTION

An exemplary embodiment of a cutting element for earth-boring drilling tool may be made of a substrate, a superhard layer bonded to the substrate along an interface between the substrate and the superhard layer. A sensing element may be operatively interfacing the superhard layer and the substrate. The sensing element may be used to measure the superhard layer's temperature, pressure, wear, magnetic properties, wear volume, force, and combinations thereof, for example. An exemplary embodiment may further include a transferring means, such as a connector, for transferring output signals from the sensing element to a circuit located in the drill bit, which in turn was sent to the operator above the ground.

Figure 1:
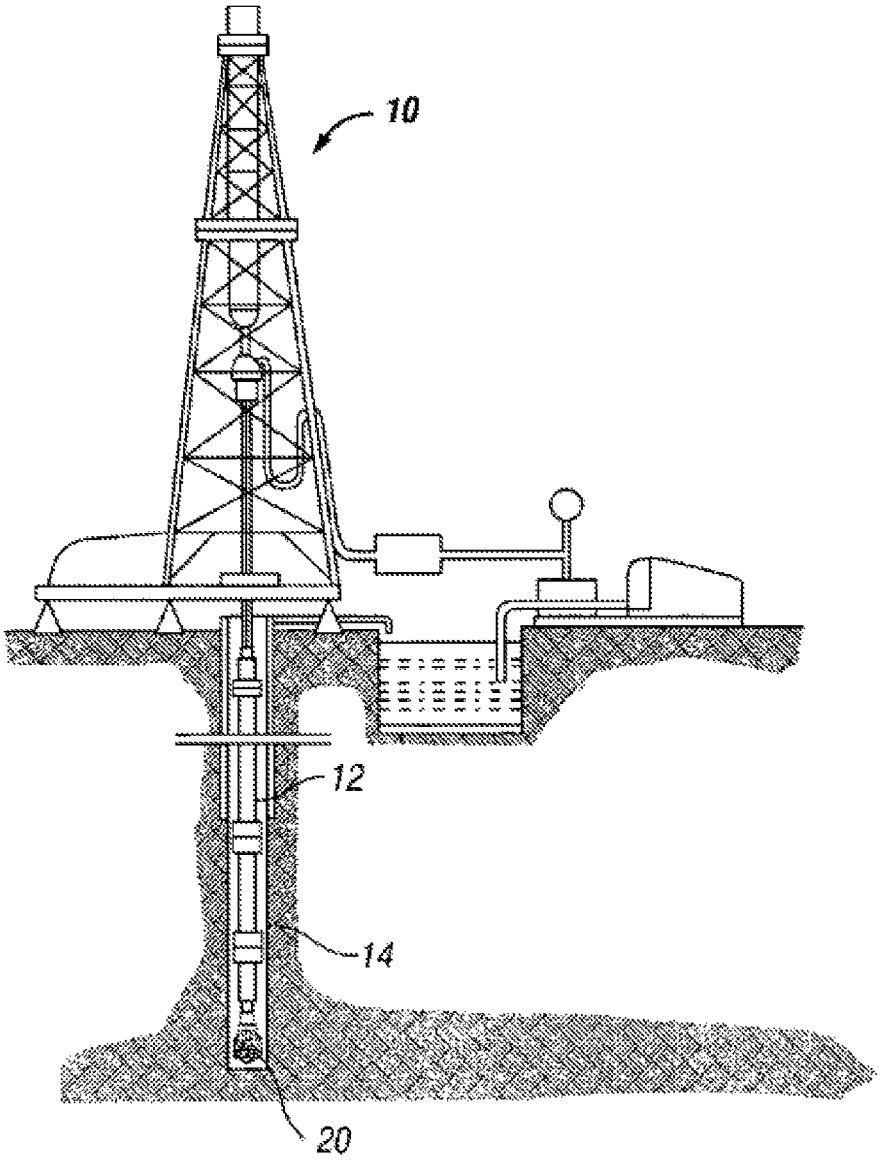
FIG. 1 (Prior Art)
FIG. 1 is a schematic diagram of a conventional drilling system which includes a drill string having a fixed cutter drill bit attached at one end for drilling bore holes through subterranean earth formations.

FIG. 1 illustrates one example of a conventional drilling system for drilling boreholes in subsurface earth formations.

Fixed cutter bits, such as PDC drill bits, are commonly used in the oil and gas industry to drill well bores. This drilling system includes a drilling rig 10 used to turn a drill string 12 which extends downward into a well bore 14. Connected to the end of the drill string 12 is a fixed cutter drill bit 20.

Figure 2:
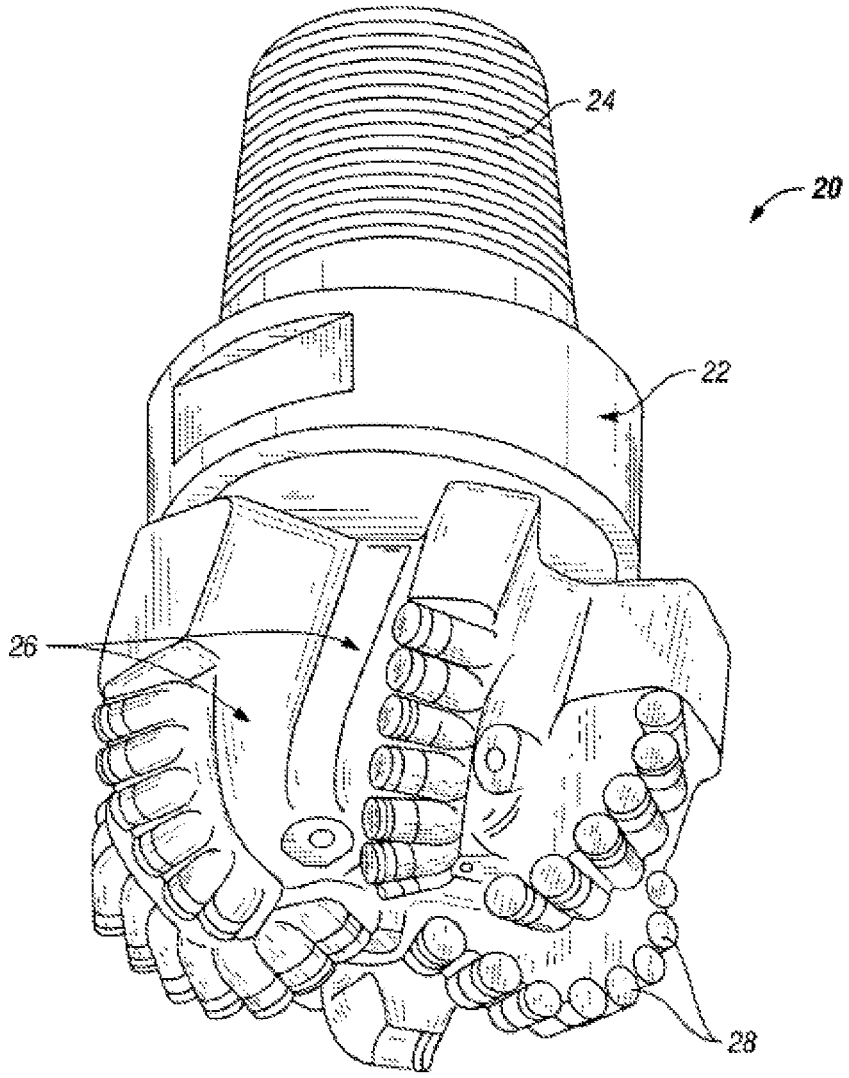
FIG. 2 (Prior Art)
FIG. 2 is a perspective view of a prior art fixed cutter drill bit.

As shown in FIG. 2, a fixed cutter drill bit 20 typically includes a bit body 22 having an externally threaded connection at one end 24, and a plurality of blades 26 extending from the other end of bit body 22 and forming the cutting surface of the bit 20. A plurality of cutting elements 28, such as cutters, may be attached to each of the blades 26 and extend from the blades to cut through earth formations when the bit 20 is rotated during drilling.

The cutting element 28 may deform the earth formation by scraping and shearing. The cutting element 28 may be a tungsten carbide insert, or polycrystalline diamond compact, a polycrystalline diamond insert, milled steel teeth, or any other materials hard and strong enough to deform or cut through the formation. Hardfacing (not shown), such as coating, for example, may also be applied to the cutting element 28 and other portion of the bit 20 to reduce wear on the bit 20 and to increase the life of the bit 20 as the bit 20 cuts through earth formations.

Figure 3A:
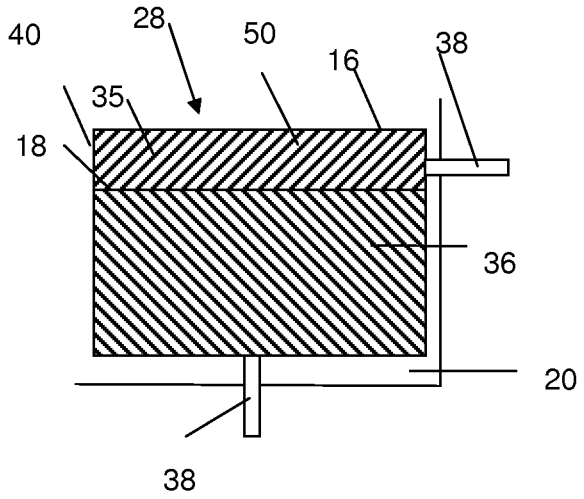
FIG. 3A is a schematic cross-sectional view of a cutting tool insert mounted in a cutter drill bit and having conductors connected to a substrate of the insert and a superhard material of the insert so that the insert can serve as a sensing device according to one exemplary embodiment.
Figure 3B:
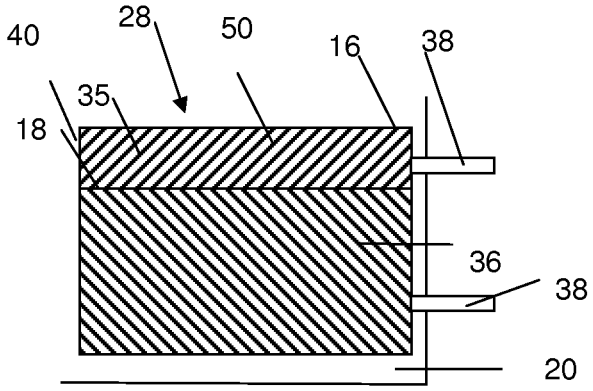
FIG. 3B is a schematic cross-sectional view of a cutting tool insert mounted in a cutter drill bit and having conductors connected to a substrate of the insert and a superhard material of the insert so that the insert can serve as a sensing device according to another exemplary embodiment.

FIGS. 3A and 3B show exemplary embodiments of a cutting element 28 mounted in the bit 20. The cutting element 28 may include a substrate 36 and a superhard layer 35 joined at an interface 18 along on at least one surface of the substrate 36. The substrate 36 may be made from a hard material such as tungsten carbide, while the superhard layer 35 may be made from a superhard material, including but not limited to a polycrystalline diamond, a composite diamond material, cubic boron nitride, or ceramic, chemical vapor deposition (CVD) diamond, leached sintered polycrystalline diamond, for example. The term, composite diamond material, used herein, refers to any materials combined with diamond, such as silica carbide, or any ceramics, for example. The superhard layer 35 may include a working surface 16 that, in operation, is placed into abrasive contact with the earth. The working surface 16 may be opposite the interface 18. The superhard layer 35 may further include an outer peripheral surface 40 which may extend between the working surface 16 and the interface 18.

The cutting element 28 may further include a sensing element 50 which may be at least part of the superhard layer 35 or the substrate 36. The sensing element 50 may be selected from a group of temperature sensors, pyroelectric sensors, piezoelectric sensors, magnetic sensors, acoustic sensors, optical sensors, infrared sensors, electrodes, electrical resistance sensors, and combinations thereof, for example. The sensing element 50 may be at least partly located within the superhard layer 35. In another exemplary embodiment, the sensing element 50 may be at least partly located or imbedded within the substrate 36, which may comprise a hard metal, such as tungsten carbide, for example.

In an exemplary embodiment, the sensing element 50 may a temperature sensor, such as a thermistor, which comprises a diamond and cobalt working layer (or surface) which changes resistance as the working layer of the cutter temperature is increased. In another embodiment, the diamond and cobalt working layer may be altered (or doped) to achieve useful electrical properties.

In other exemplary embodiments, the superhard layer 35 may comprise compact of a superabrasive with other catalysts or binder phases (as known) that change resistance as the temperature of the working layer is increased.

In yet another exemplary embodiment, the sensing element 50 may be thermal pyrometer comprising a diamond and cobalt working surface 16 which emits photons as the temperature of the working layer of the cutting element 28 is increased.

In further other embodiments, the sensing element 50 may be a thermoelectric device comprising two regions of diamond with different doping states.

In the depicted embodiments of FIGS. 3A and 3B, the cutting element working surface 16 may itself act as an integral sensing device such as a resistance thermocouple, strain sensor, optical emitter, A transferring means, such as a connector 38, may be attached to the superhard layer 35, and another transferring means, such as a connector 38, may be attached to the substrate 36 to extract sensor information.

Still in FIGS. 3A and 3B, the thermistor may be integrated with the working layer 16 and the resistance change may be detected by two electrodes extending into the working layer. The conductors may be doped diamond, conductive cBN materials, conductive refractory metals or their compounds. These electrodes may extend through the substrate 36 and may be insulated from the substrate by nonconductive materials such as oxides, glass, nonconductive diamond or cBN or other non-conductors. As the temperature of the cutting element 28 increases, its resistance increases, and the increase in resistance may be measured between a connector attached to the substrate 36 and another connector attached to the superhard layer 35. To refine the calibration of the resistance, one or both of the substrate 36 and the superhard layer 35 may be modified (or doped) with a resistance element. Thermoelectric elements may also be made from polycrystalline diamond (PCD) which forms part or the entire superhard layer 35. Alternatively, optical sensors, utilizing the diamond as an emitter element, may be used to measure temperature at different surfaces of the cutting element 28.

One exemplary embodiment may be the integral thermistor that may be placed in the cutting element 28 so the temperature-measuring region essentially coincides with the cutting surface 16. The thermistor itself may be then worn as the superhard layer 35 is worn. At the wear front, the two leads of the thermocouple are continually welded together due to the force and frictional heat of cutting, so that temperature may continue to be monitored even as the thermocouple itself wears away. Also, changes in resistance, including infinite resistance, may be used to quantify wear and tear.

In another exemplary embodiment, the integral working layer sensing element 50 may act as a pyro electric or a piezoelectric sensor. These sensors may be used to measure vibration, impulse force, or machine chatter, which are indications of the amount of force or load being applied to the cutting element 28. These sensors may also be used to determine volume changes in the insert (e.g., due to phase change as a result of loss of volume from erosion or wearing away of the insert).

Acoustic or ultrasonic integral sensors comprising the working layer or surface may be used to measure vibration, volume changes, and even location of the cutting element 28 in the hole. An acoustic or ultrasound sensor may also be used to detect imminent or actual cracks in the cutting element 28.

In a further exemplary embodiment, the sensing element 50 may be an integral capacitance sensor to detect capacitance or capacitive losses from inside or from the surface of the insert. Capacitance may be used to provide information about wear of the cutting element 28.

In another exemplary embodiment, an active sensing element may be incorporated in a leached diamond working surface. It is well-known in the art to remove or partially remove catalytic metal phase from the near surface of a diamond cutting insert. In this example the removed catalytic metal, normally Cobalt, for example, may be replaced with another material with advantages as a sensor. For example, the cobalt may be replaced with gold which has a higher thermal coefficient of resistance and may increase the sensitivity of the integral thermistor. The conductive paths may extend sufficiently to reach this modified layer.

In another exemplary embodiment, a different type of active sensor element may be incorporated in a leached diamond working surface. In this embodiment, the removed catalytic metal, normally cobalt, is replaced with two different materials each in discrete areas of the working surface with a common area or junction to form a thermoelectric element. For example, the cobalt may be replaced with a nickel chromium alloy in one region and a nickel manganese alloy in a second region with a common interface to create the thermoelectric element. Other thermoelectric material combinations are possible to obtain the needed temperature sensitivity, magnetic properties, or corrosion resistance. The conductive paths may now extend sufficiently to reach these modified layers.

In another exemplary embodiment, integral optical sensors comprising an optical interferometer that may be used to detect the deformation of a cutting tool insert, which may be an indication of wear, shear force, and normal force on the insert. Alternatively, a discrete optical transducer can be incorporated in the cutter. The discrete optical transducer may comprise a material having an index of refraction that changes with temperature, such as Lithium Niobate. This discrete sensor may be a part of the cutting element, but not composed of the same material as the cutter working surface. Optical interferometry may then be carried out with such a transducer using a laser to measure an index of refraction through the material.

In another example, two Raman peaks of positively-charged Erbium ions ($Er^{+3}$) may be compared, and the ratio of intensities correlated with temperature. A carrier for the Erbium may be made from AlN, AlGaN, or Cr, any of which provides good thermal conductivity for the $Er^{+3}$ ions. The integral electrical or optical sensor may be incorporated in the working layer, by replacing the catalyst metal with the electrically or optically active phase.

In addition, multiple integral sensors may be employed at different locations on a single insert, or on a plurality of inserts on the same boring bit, to detect gradients in temperature, pressure, force, deformation, vibration, and any other parameter that may be measured by the sensors. In particular, by mounting force-detecting sensors on multiple inserts, shear and normal forces across the boring bit may be determined.

While sensors integrated to the working surface, may provide information about cutter conditions, as discussed above, it is envisioned that one or more cutting element may be employed as sacrificial or performance-measuring inserts. For example, a compromised cutting element may be prepared by cutting or slicing the body of the insert and then back filling the cuts or slices with material and/or sensors. The body can be sliced partially or completely in an axial or radial direction, which allows for electrical or force separation between parts on opposite sides of a slice (i.e., forming a P-N junction or a piezoelectric sandwich).

Alternatively, a sacrificial insert may be formed entirely of a substrate material such as tungsten carbide, without a superhard layer to form a cutting surface. Such an insert is easier to form than an insert having a superhard layer, since the superhard material is typically formed and fused to the substrate in a high-temperature high-pressure process that may be too extreme for some sensors to survive. The sacrificial insert can be placed in the cutting "shadow" of another insert to provide information on wear, mud conditions, force, and other parameters, but cannot provide cutting edge temperatures of the other insert.

In operation, when both connectors 38 are connected to a circuit (not shown) in the drilling bit 20, in one exemplary embodiment, under a pre-determined voltage, current may flow from a first connector 38 through the sensing element 50, which comprises conductive materials, such as cobalt, in at least part of the superhard layer, then cross the interface 18, to the sensing element, which comprises conductive materials, such as cobalt, tungsten, in at least part of the substrate 36, finally to a second connector 38. Information, such as resistance, may be calculated via dividing the pre-determined voltage by detected current, for example.

When cutting element 28 abrades rocks of earth formation, heat is generated. As superhard layer temperature increases, properties of the superhard layer changes, such as resistance. A change of resistance may be sensed by the circuit in the drilling bit 20, which in turn may be sent to an operator above the ground.

In another exemplary embodiment, current may flow from a second connector 38 through the sensing element 50, which comprises conductive materials, such as cobalt, tungsten, in at least a part of the substrate 36, then flow across the interface 18, to the sensing element in at least part of the substrate 35, then finally to a second connector 38.

Figure 4:
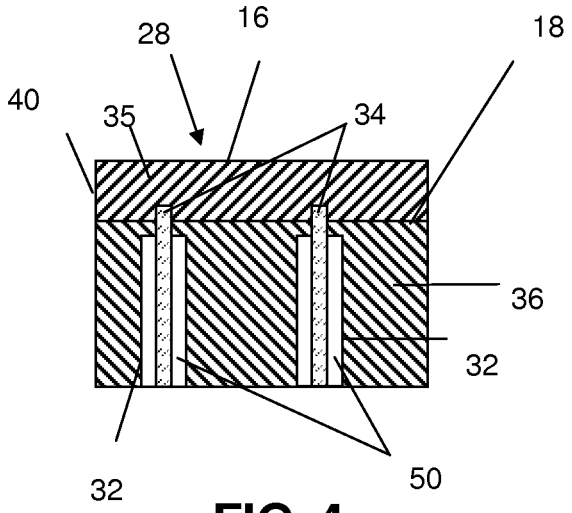
FIG. 4 is a schematic cross-sectional view of a cutting tool insert showing electrical, optical or other contacts with the working surface of the earth boring cutting element according to yet another exemplary embodiment.

FIG. 4 shows another exemplary embodiment of a cutting element 28 having two electrical or optical pathways 34 mounted therein. The sensing element 50 may comprise a portion of the superhard layer 35. In the depicted embodiment, the pathways 30 may be mounted in apertures 32 bored into the rear side of the substrate 32 of the insert 28. The pathways 34 to extract sensing response may extend into an interior portion of the substrate 36 close to the interface 18 between the substrate 36 and the superhard layer 35. To further increase the accuracy of the sensing element 50 in detecting conditions at or near the cutting surface 16, conductive or optical pathways 34 in the superhard layer 35 may be provided to extend beyond the interface 18 and an end of the insulating or passive material of substrate 36.

An exemplary embodiment of the sensing element 50 may be an integral sensor that utilizes the superhard layer 35 metal phases as an active part of the thermoelectric device. For instance if the binder phase were to consist of pure Cobalt, the thermal resistance coefficient may be used to measure the temperature between wires inside passage way 34 extending into the superhard layer 35.

It may also be possible to create a thermoelectric element from most dissimilar materials. An example may be producing a thermoelectric element of diamond and boron compounds; diamond and refractor metals; or doped Silicon carbide conductors and diamond.

Still in FIG. 4, an exemplary embodiment of another such sensing element may be to use optical fibers inside passage way 34 to carry out optical pyrometer using diamond in the superhard layer 35 as a photon emitter to measure the infrared emission of the metal binder or diamond. An example of another sensor might be to use optical fibers in the passage ways 34 to measure the Raman shift of Diamond in the superhard layer 35. This would reveal stress or strain of the superhard layer 35.

With multiple electrical, optical, or capacitive contacts to the superhard layer, an array of sensors may be used. These arrays of sensors may be used to collect more information or, as cutter wear destroys the array PCD sensing elements, a quantitative description of cutter wear may be obtained.

Regardless the configuration, one or more sensing element 50 may be selected from a wide range of sensors to measure different parameters that provide various types of information regarding the status of the cutting element 28. The sensing element 28 may be used to generate information relating to the superhard layer 35. Each sensing element 50 may include one or more sensors for detecting operational parameters capable of indicating the state of the cutting element 28.

By detecting such parameters, it may be determined whether the cutting operation is being conducted too aggressively, which may risk failure of the cutting element 28, or too conservatively, which may result in longer boring times than necessary. For example, monitoring the temperature of the working surface of the cutting element 28 near the cutting surface 16 enables an operator to detect wear to the superhard layer 35 so that drilling parameters, such as torque, weight on the bit (WOB), and rotational speed (RPM), may be adjusted to avoid tool failure. Rising temperature is a particularly strong indicator of impending tool failure because increased temperature at the cutting surface 16 may signal increased friction, which further increases temperature until the superhard layer 35 ultimately may be delaminated from the substrate 36 or the superhard layer 35 may reach such a high coefficient of friction that the drilling bit grinds to a halt.

An earth boring diamond (PCD) cutter as shown in FIG. 4 may be produced with an integral thermistor. Diamond particles are placed in a 14 mm diameter by 10 mm tall tantalum container to a depth up to about 4 mm. A hard metal substrate with through vias is placed in the same tantalum cup. Aluminum oxide tubing and tantalum electrodes are placed in the vias so that the tantalum metal electrode and aluminum oxide sleeve penetrate into the diamond powder layer about 1 mm. A second tantalum cup is placed over the rear of the assembly. The cup, diamond powder, hard metal substrate, insulators, and electrode assembly is sintered at pressure of over 50 kbar and over 1300° C. to form sintered diamond layer and integral substrate with electrodes. After sintering the tantalum cups are ground away to create a conventional 13 mm by 8 mm tall cutting insert with a 2 mm diamond layer. The distal (to the working surface) end of the substrate may be ground to expose the tantalum electrodes. The integral sensor exposed to increasing temperatures and the resistance response is measured between the exposed electrodes for calibration purposes. The earth boring PCD cutter, with the integral thermistor is incorporated in an earth boring bit that comprises connectors, data collection, data storage, and telemetry capability to allow transmission of the temperature information to the drill rig operator.

An earth boring diamond (PCD) cutter as shown in FIG. 4 may be produced with an integral optical emitter for temperature measurement. Diamond particles are placed in a 14 mm diameter by 10 mm tall tantalum container to a depth up to about 4 mm. A hard metal substrate with at least one through via is placed in the same tantalum cup. A transparent optical pathway, examples being sapphire or quartz, diamond, or fused silica, or a hole, is placed in the vias so that the transparent pathway penetrates into the diamond powder layer about 1 mm.

A second tantalum cup is placed over the rear of the assembly. The cup, diamond powder, hard metal substrate, and optical pathway are sintered at pressure of over 50 kbar and over 1300° C. to form a sintered diamond layer and integral substrate with an optical pathway. After sintering, the tantalum cups are ground away to create a conventional 13 mm by 8 mm tall cutting insert with a 2 mm diamond layer. The distal (to the working surface) end of the substrate is ground to expose the optical pathway. The diamond emitter is exposed to increasing temperatures and optical emission at the distal end of the cutter is measured for calibration purposes. The earth boring PCD cut, with the integral optical emitter is incorporated in an earth boring bit that comprises optical sensing, data collection, data storage, and telemetry capability to allow transmission of the temperature information to the drill rig operator.

While reference has been made to specific embodiments, it is apparent that other embodiments and variations can be devised by others skilled in the art without departing from their spirit and scope. The appended claims are intended to be construed to include all such embodiments and equivalent variations.

We claim:

1. A cutting element for an earth-boring drilling tool, comprising:

a substrate bonded to one side of an interface;

a superhard layer bonded to the substrate along the opposite side of the interface, the superhard layer having a working surface opposite the interface and an outer peripheral surface extending between the working surface and the interface; and;

a sensing element comprising a connector that is coupled to a thermoelectric element within the superhard layer, the connector and the thermoelectric element within the superhard layer forming the sensing element that is integral to the superhard layer, the connector transferring output signals from the sensing element for remote monitoring of a condition of the superhard layer, wherein the substrate surrounds and encompasses the sensing element which crosses the interface and is in electrical contact with the thermoelectric element within the superhard layer.

2. The cutting element for earth-boring drilling tool of claim 1, wherein the sensing element measures one or more parameters selected from a group of temperature, pressure, wear, magnetic properties, wear volume, force, acceleration, electrical conductivity and combinations thereof.

3. The cutting element for earth-boring drilling tool of claim 1, further comprises transferring means for transferring output signals from the sensing element through a connector.

4. The cutting element for earth-boring drilling tool of claim 1, wherein the sensing element comprises an entire superhard layer.

5. The cutting element for earth-boring drilling tool of claim 1, wherein the superhard layer comprises diamond.

6. The cutting element for earth-boring drilling tool of claim 1, wherein the sensing element is incorporated into a leached diamond working surface.

7. The cutting element for earth-boring drilling tool of claim 1, wherein the sensing element is incorporated into a leached diamond working surface.

8. The cutting element for earth-boring drilling tool of claim 1, wherein a catalytic metal removed from the diamond working surface is replaced by at least one of gold, nickel chromium and nickel manganese.

9. A cutting element for an earth-boring drilling tool, comprising:

a substrate bounded to one side of an interface layer, the substrate surrounding and enclosing the sensor;

a sensor comprising of a connector that is coupled to a thermoelectric element, the connector and the thermoelectric element forming the sensing element, the connector transferring output signals from the sensing element through an interface layer, wherein the sensing element comprises one of a pyroelectric sensors and a piezoelectric sensors; and a superhard layer bonded to the substrate along an opposite side of the interface, the superhard layer having a working surface opposite the interface and an outer peripheral surface extending between the working surface and the interface.

10. The cutting element for an earth-boring drilling tool of claim 9, wherein the sensing elements are configured to indicate the amount of force or load being applied to the cutting element.

11. The cutting element for an earth-boring drilling tool of claim 9, wherein the sensing element is configured to determine volume changes in cutting tool insert.

12. The cutting element for earth-boring drilling tool of claim 9, wherein the sensing element measures one or more parameters selected from a group of temperature, pressure, wear, magnetic properties, wear volume, force, acceleration, electrical conductivity and combinations thereof.

13. The cutting element for earth-boring drilling tool of claim 9, wherein the sensing element comprises an entire superhard layer.

14. The cutting element for earth-boring drilling tool of claim 9, wherein the superhard layer comprises diamond.

15. The cutting element for earth-boring drilling tool of claim 9, wherein the sensing element is incorporated into a leached diamond working surface.

16. The cutting element for earth-boring drilling tool of claim 9, wherein a catalytic metal is at least partially removed from the diamond working surface.

17. The cutting element for earth-boring drilling tool of claim 9, wherein a catalytic metal removed from the diamond working surface is replaced by at least one of gold, nickel chromium and nickel manganese.

* * * * *